US006075486A

United States Patent [19]

Hakozaki

[11] Patent Number: 6,075,486

[45] Date of Patent: Jun. 13, 2000

[54] ANTENNA DEVICE

[75] Inventor: Hirotoshi Hakozaki, Tokyo, Japan

[73] Assignee: Mitsubishi Denki Kabushiki Kaisha, Tokyo, Japan

[21] Appl. No.: 09/233,094

[22] Filed: Jan. 19, 1999

[30] Foreign Application Priority Data

Jul. 3, 1998 [JP] Japan ..... 10-188797

[51] Int. Cl.[7] ..... H01Q 1/38; H01Q 1/32

[52] U.S. Cl. ..... 343/700 MS; 343/713; 343/893; 343/906

[58] Field of Search ..... 343/700 MS, 906, 343/893, 713, 770, 776, DIG. 2; H01Q 1/38, 1/32

[56] References Cited

U.S. PATENT DOCUMENTS 5,442,366 8/1995 Sanford ..... 343/700 MS
5,471,220 11/1995 Hammers et al. ..... 343/700 MS
5,633,646 5/1997 Strickland ..... 343/700 MS
5,724,048 3/1998 Remondiere ..... 343/700 MS

FOREIGN PATENT DOCUMENTS 9-16948 6/1997 Japan .

*Primary Examiner*—Don Wong
*Assistant Examiner*—Hoang Nguyen
*Attorney, Agent, or Firm*—Sughrue, Mion, Zinn, Macpeak & Seas, PLLC

[57] ABSTRACT

An antenna device realized in a small size and at a decreased cost owing to a reduction in the feeder circuits and in the harness portion. The antenna device includes a plurality of antenna units 11 to 18 integrally arranged neighboring each other, and a core unit 20 arranged integrally with said antenna units to feed electric power to said antenna units, wherein each of said antenna units and said core unit has detachable joining/securing portions and connector portions, and each of said antenna units is electrically connected to said core unit via said connector portions. The antenna units required by a user are divided into blocks for each of the functions and are selectively utilized in an aggregated manner.

13 Claims, 7 Drawing Sheets

ANTENNA DEVICE

BACKGROUND OF THE INVENTION

1. Field of the Invention

The present invention relates to an antenna device mounted, for example, on a car and having a plurality of antenna units. More particularly, the invention relates to an antenna device in which a variety of antenna units are structurally and electrically uniformalized and aggregated together.

2. Prior Art

FIG. 9 is a perspective view illustrating, in a disassembled manner, a conventional antenna device disclosed in, for example, Japanese Unexamined Patent Publication (Kokai) No. 169248/1997 together with the peripheral structure thereof in the case where the antenna device to be mounted on a car is incorporated in a roof module.

In FIG. 9, an antenna unit 2 and a control unit 3 are incorporated as a unitary structure in a molded substrate 1 that constitutes a roof module A of an automobile (not shown), and a circuit conductor 4 is arranged therein.

The circuit conductor 4 electrically connects the antenna unit 2 and the control unit 3 together, and guides the signals received by the antenna unit 2 to an external circuit device.

A room mirror 5 and a sun visor 6 constitute the roof module A together with the molded substrate 1.

The antenna unit 2 is constituted by, for example, the one for navigation.

Though not diagramed here, another antenna unit for, for example, an automatic fee receiving system (hereinafter abbreviated as "ETC") is incorporated in another module mounted on the car.

According to the conventional antenna device as shown in FIG. 9, the mounting position has been limited to be, for example, in the roof module. It is not, therefore, allowed to arbitrarily select and install an antenna unit required by a user.

That is, the roof module A of FIG. 9 incorporates the antenna unit 2 for receiving radio waves or navigation waves only. In order to incorporate an antenna unit for other functions such as of TV, therefore, a separate module must be mounted on the car.

In general, furthermore, the shape of the roof module differs depending upon the vehicles. Therefore, it is not allowed to, or it cannot be expected to, easily incorporate a plurality of antenna units, since it is difficult to standardize or uniformalize the roof modules among the manufacturers or among the models of the cars.

SUMMARY OF THE INVENTION

According to the conventional antenna device, as described above, the position for mounting the antenna unit 2 is limited to the roof module A. Besides, it is not allowed to aggregate all other antenna units integrally together, resulting in a wasteful wiring structure and making it difficult to reduce the size or to decrease the cost.

The present invention was accomplished in order to solve the above-mentioned problem, and its object is to provide an antenna device in which the antenna units required by the user are divided into blocks depending upon the functions, so that they can be arbitrarily selected and can be constituted in an aggregated manner, making it possible to reduce the feeder circuit and the harness portions and, hence, to reduce the size and to decrease the cost.

The antenna device according to the present invention comprises:

a plurality of antenna units integrally arranged neighboring each other; and a core unit arranged integrally with said antenna units to feed electric power to said antenna units; wherein, each of said antenna units and said core unit has detachable joining/securing portions and connector portions; and each of said antenna units is electrically connected to said core unit via said connector portions.

In the antenna device of the present invention, furthermore, the joining/securing portions and the connector portions of each of the antenna units are provided on at least one surface thereof opposed to said core unit, and the joining/securing portions and the connector portions of said core unit are provided on the surfaces thereof opposed to at least one of said antenna units.

In the antenna device of the present invention, said antenna units and said core unit have quadrilateral planes, said antenna units are arranged in the form of a matrix with the core unit as a center, the antenna units neighboring said core unit among said antenna units are directly coupled to said core unit via said connector portions, the antenna units that are not neighboring said core unit among said antenna units are directly coupled to other neighboring antenna units via said connector portions and are electrically connected to said core unit via said other antenna units.

In the antenna device of the present invention, furthermore, said core unit has a circular plane, and said antenna units are arranged like a ring along the outer peripheral surface of said core unit with said core unit as a center, and are directly coupled to said core unit via said connector portions.

In the antenna device of the present invention, furthermore, at least either said antenna unit or said core unit has a mounting portion on the surface thereof opposed to an external equipment so as to be secured to said external equipment.

In the antenna device of the present invention, furthermore, provision is made of a case substrate for containing said antenna units and said core unit integrally together, and said case substrate has detachable joining/securing portions and connector portions on the surfaces thereof opposed to said antenna units and said core unit.

In the antenna device of the present invention, said case substrate has a plurality of accommodation spaces that are divided to individually correspond to said antenna units and said core unit.

In the antenna device of the present invention, said case substrate has a mounting portion on the surface thereof opposed to an external equipment so as to be secured to said external equipment.

In the antenna device of the present invention, said antenna units have separate antenna elements, filter circuits and amplifiers having different characteristics.

In the antenna device of the present invention, furthermore, said core unit has a harness portion for connecting the transmission/reception lines and the power source lines for said antenna units to an external circuit device in an aggregated manner.

In the antenna device of the present invention, furthermore, said plurality of antenna units include at least any one of an AM antenna unit, an FM antenna unit, a TV antenna unit, a navigation antenna unit, an ETC antenna unit and an amateur wireless antenna unit mounted on a car.

In the antenna device of the present invention, furthermore, said antenna units are arranged in an aggregated manner in the roof module of the vehicle.

In the antenna device of the present invention, furthermore, said antenna units are arranged in an aggregated manner on the upper surface of the inner wall of the engine room, trunk room or the roof of the vehicle.

DESCRIPTION OF THE EMBODIMENTS

Embodiment 1

An embodiment 1 of the present invention will now be described with reference to the drawings.

Figure 1:
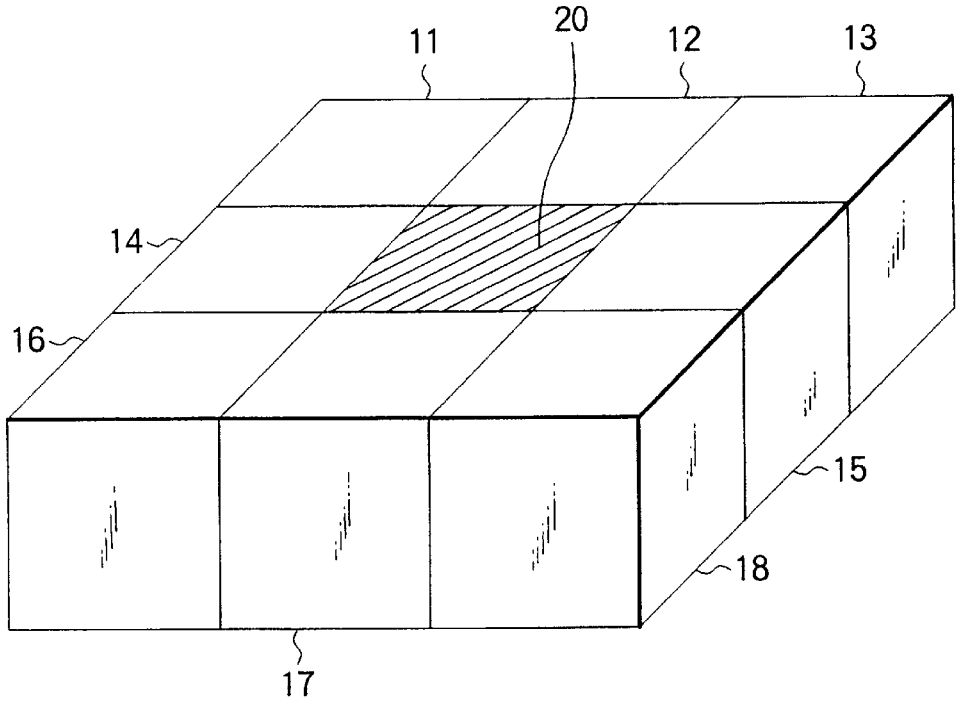
FIG. 1 is a perspective view illustrating an embodiment 1 of the present invention.
Figure 2:
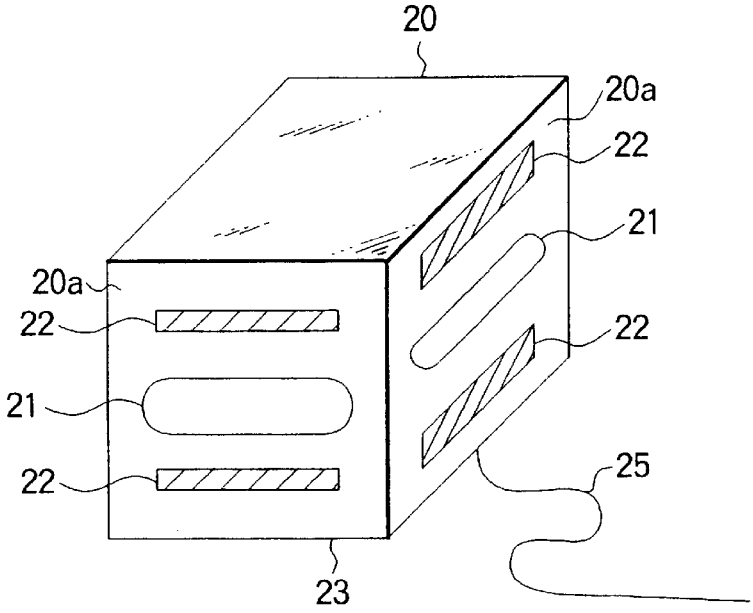
FIG. 2 is a perspective view showing a core unit according to the embodiment 1 of the present invention.
Figure 3:
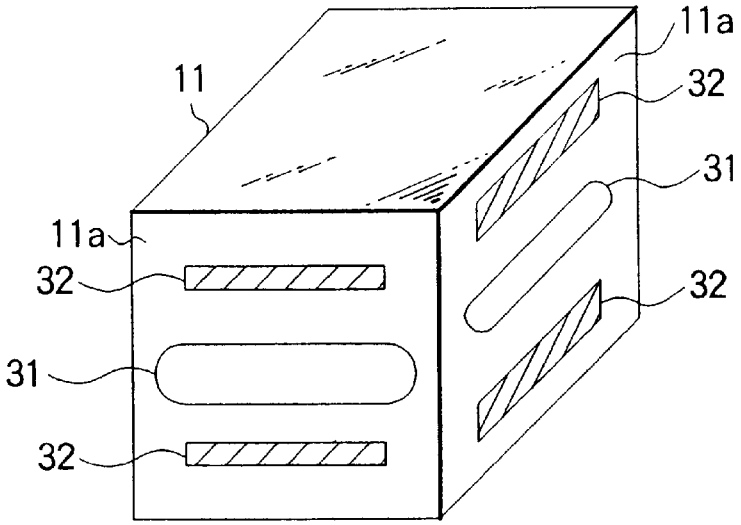
FIG. 3 is a perspective view showing an antenna unit according to the embodiment 1 of the present invention.
Figure 4:
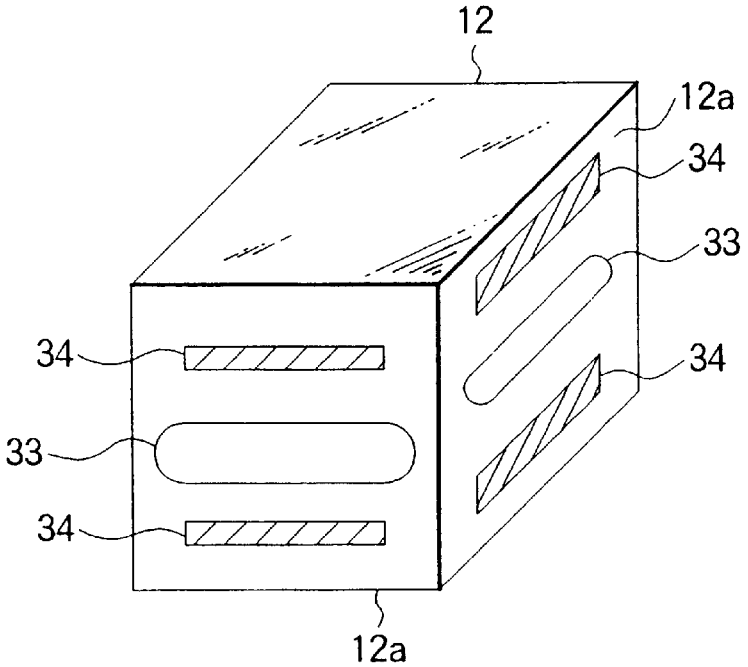
FIG. 4 is a perspective view showing the antenna unit according to the embodiment 1 of the present invention.

FIG. 1 is a perspective view schematically illustrating the embodiment 1 of the present invention, FIG. 2 is a perspective view illustrating, on an enlarged scale, a core unit only of FIG. 1, and FIGS. 3 and 4 are perspective views illustrating, on an enlarged scale, antenna units only of FIG. 1.

In FIG. 1, a plurality of antenna units 11 to 18 are integrally arranged neighboring each other.

The core unit 20 working as a power source circuit is arranged integrally with the antenna units 11 to 18, and feeds electric power to the antenna units 11 to 18.

The antenna units 11 to 18 and the core unit 20 have quadrilateral planes, and the antenna units 11 to 18 are arranged in the form of a matrix with the core unit 20 as a center.

In FIG. 2, the core unit 20 has detachable connector portions 21 and joining/securing portions 22 on four surfaces 20*a* opposed to the antenna units, and has a mounting portion (threaded hole, etc.) formed in the bottom surface 23 thereof opposed to an external equipment (not shown) so as to be secured to the external equipment.

The core unit 20 further has a harness portion 25 for connecting the transmission/reception lines and the power source lines for the antenna units 11 to 18 to an external circuit device (which will be described later) in an aggregated manner.

Referring to FIG. 3, the antenna unit 11 that is not neighboring the core unit 20 among the antenna units, has detachable connector portions 31 and joining/securing portions 32 on the two surfaces 11*a* opposed to the antenna units 12 and 14.

In FIG. 4, furthermore, the antenna unit 12 neighboring the core unit 12 among the antenna units, has detachable connector portions 33 and joining/securing portions 34 on the three surfaces 12*a* opposed to the antenna units 11, 13 and the core unit 20.

Though FIGS. 3 and 4 representatively illustrate the antenna units 11 and 12 only, it should be noted that other antenna units arranged maintaining similar relationships to the antenna units 11 and 12, are constituted in the same manner as the antenna units 11 and 12.

That is, the antenna units 13, 16 and 18 similar to the antenna unit 11, are constituted in the same manner as the antenna unit 11, and the antenna units 14, 15 and 17 similar to the antenna unit 12, are constituted in the same manner as the antenna unit 12.

The antenna units 11 to 18 possess the connector portions on all surfaces opposed to other antenna units. They, however, need have a connector portion on at least one surface to maintain power source lines and transmission/reception lines for the core unit 20.

By using independent antenna units 11 to 18 and core unit 20 as shown in FIGS. 2 to 4, it is allowed to arrange the antenna units 11 to 18 and the core unit 20 electrically and structurally together in an aggregated manner as shown in FIG. 1 through the opposing connector portions and the joining/securing portions.

For instance, the antenna unit 11 is directly coupled to the antenna unit 12 via the connector portions 31 and 33, and is electrically connected to the core unit 20 via the antenna unit 12. Similarly, the antenna unit 16 is electrically connected to the core unit 20 via the antenna unit 14.

That is, the antenna units 11, 13, 16 and 18 that are not directly coupled to the core unit 20, are directly coupled to other neighboring antenna units 12, 14, 15 and 17 via the connector portions thereby to form data transmission/reception routes relative to the core unit 20.

The antenna unit 12, on the other hand, is directly coupled and electrically connected to the core unit 20 via the connector portions 33 21.

That is, the antenna units 12, 14, 15 and 17 neighboring the core unit 20 are directly coupled to the core unit 20 via the connector portions thereby to form data transmission/reception routes.

Thus, the core unit 20 is allowed to supply electric power and electric signals to any number of antenna units through the connector portions.

The joining/securing portions on the opposing surfaces work to join and secure the core unit 20 and the antenna units 11 to 18 together.

The harness portion 25 enables signals to be exchanged between the core unit 20 and an external circuit device (e.g., high-order modulator/demodulator), and enables electric power to be supplied to the core unit 20 from a battery mounted on the car.

The mounting portion formed in the bottom surface 23 of the core unit 20 works to secure the antenna device constituted as shown in FIG. 1 onto an external equipment (e.g., any place on the body of the vehicle).

The mounting portion is formed in at least one opposing surface of either the antenna units 11 to 18 or the core unit 20.

Figure 5:
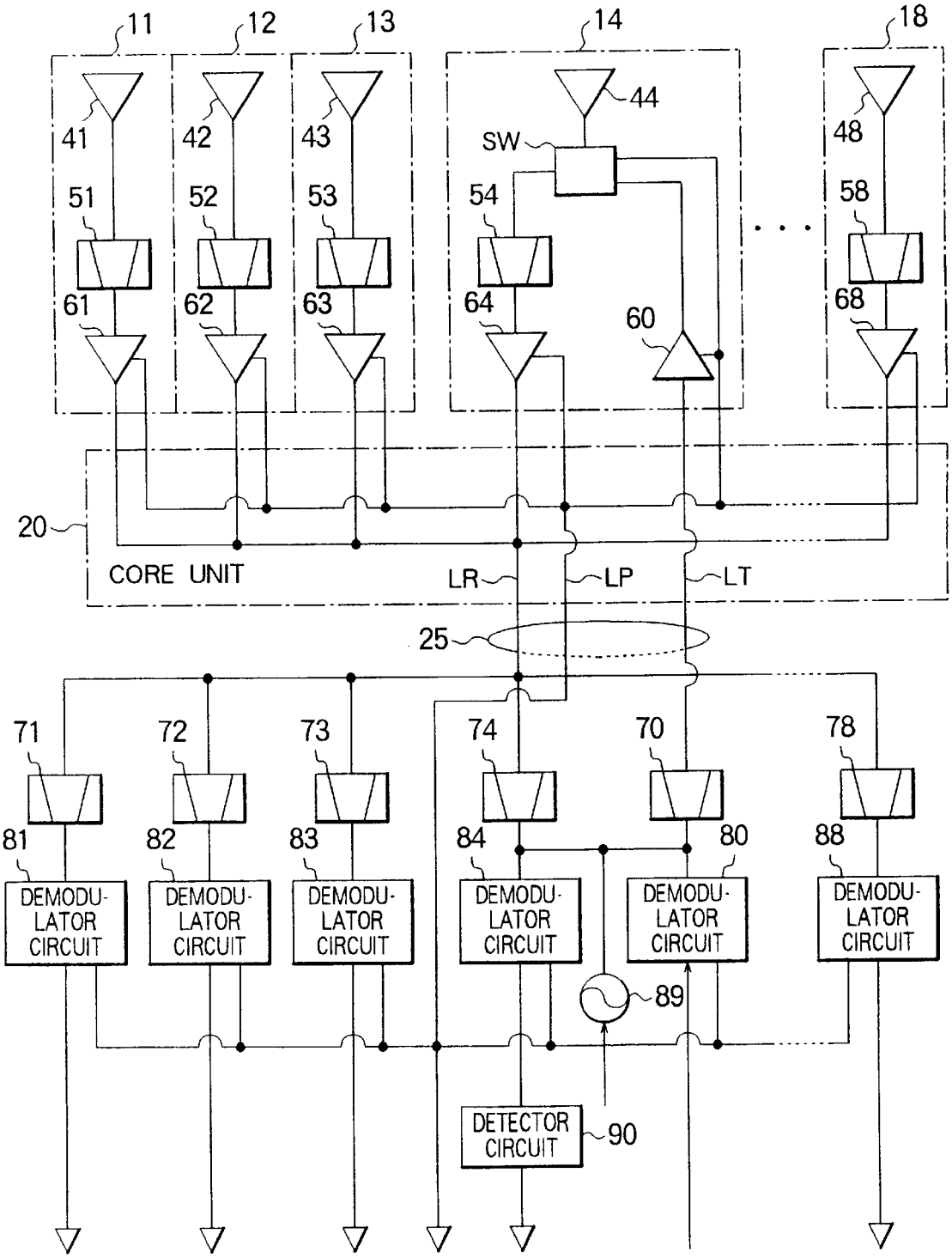
FIG. 5 is a block diagram illustrating the circuit constitution according to the embodiment 1 of the present invention.

FIG. 5 is a block diagram schematically illustrating the circuit constitution of the embodiment 1 of the present invention.

In FIG. 5, the antenna units 11 to 18 have separate electronic circuits functioning as antennas.

That is, the antenna units 11 to 18 include antenna elements 41 to 48, filter circuits 51 to 58 for high frequencies, and amplifiers 61 to 58 for reception, as electronic circuits having different characteristics.

In this case, furthermore, the antenna units 11 to 18 are divided into blocks for each of the functions of the antennas mounted on the car required by the user of the car, and any number of antennas having any functions are selected as described below though there is no particular limitation.

For instance, the antenna unit 11 is an antenna for AM, the antenna unit 12 is an antenna for FM and TV, the antenna unit 13 is an antenna for navigation, the antenna unit 14 is an antenna for ETC (automatic fee receiving system), and the antenna unit 18 is an antenna for amateur wireless communication.

The antenna unit 14 for ETC includes an amplifier 60 for transmission and a switch SW for changing the antenna element 44 over to transmission or reception, in addition to the above-mentioned circuit constitution.

Furthermore, the core unit 20 working as a power source circuit has power source lines LP and reception lines LR for the antenna units 11 to 18, as well as a transmission line LT for the antenna unit 14 that are aggregated in a harness portion 25 and are connected to an external circuit device such as tuner or the like.

The external circuit device connected to the core unit 20 via the harness portion 25 includes a band-pass filter 70 for selecting the frequency of transmission signals, band-pass filters 71 to 78 for selecting the frequencies of the received signals, a demodulator circuit 80 for the transmission signals, demodulator circuits 81 to 88 for the received signals, a local frequency oscillation circuit 89 connected to demodulator circuits 80 and 84 related to the antenna unit 14, and a detector circuit 90 inserted on the output side of the demodulator circuit 84.

The power-source line LP is connected, as an external circuit device, to, for example, a battery mounted on the car.

In order to transmit and receive the data, furthermore, general connectors are used for connecting the antenna units 11 to 18 to the core unit 20.

In the connector portion, for example, the arrangement of connection terminals for control signals and power source signals have been standardized. The connector portion includes a pair of power source terminals and a pair of ground terminals, terminals for transmitted and received control signals, transmission terminals and reception terminals of a number corresponding to the number of the antenna units.

The antenna units 11 to 18 have a predetermined shape as shown in FIGS. 1 to 4 irrespective of the application functions such as AM radio, FM radio, TV, navigation system or ETC.

Thus, a plurality of antenna units 11 to 18 are fabricated as a unitary structure together with the core unit 20 to constitute the circuit shown in FIG. 5. Therefore, despite of the number of the antenna units is increased, the duplicated common elements such as wirings can be decreased and can be selectively installed in an aggregated manner at any place in the facility mounted on the car, such as in the roof module.

That is, the feeder circuits that are duplicated for the antenna units 11 to 18 and the harness portion 25 can be used in common and can be aggregated together.

Moreover, the connection terminals in the connector portions are electrically standardized to decrease the number of parts, length of the wiring, number of the steps for mounting and the time for mounting.

Therefore, a number of antenna units can be fabricated integrally together in small size with ease despite the antenna units are employed for the application of multimedia in a vehicle which has been increasingly demanded, particularly, in recent years.

Therefore, no duplicated common portion is required, making it possible to decrease the cost, and the place for installing the antenna device can be freely selected.

By forming the antenna units 11 to 18 in the form of blocks of a predetermined shape, furthermore, any antenna unit can be selectively used to receive electromagnetic waves for radio, TV and navigation depending upon the functions required by the user, and can be easily detachably mounted on the antenna device integrally together.

By arranging the amplifiers 60 to 68 in the antenna units 11 to 18, furthermore, the received data are amplified near the antenna elements 41 to 48, the length of the harness is decreased to decrease the noise and, hence, the SN ratio is decreased to improve the NF (noise factor: reception characteristics).

In general, furthermore, the power source for a lamp in the room is arranged in the roof module. By selecting the roof module as a place for mounting the aggregated antenna device as shown in FIG. 1, therefore, the wiring to the power source can be further effectively decreased.

Furthermore, the antenna device is fabricated integrally with the roof module in which are aggregated various indoor devices mounted on the roof of the car and the wirings thereof, facilitating the operation for assembling the optional electric parts such as sun roof and the like.

Embodiment 2

In the above-mentioned embodiment 1, the antenna device was arranged in the roof module of the vehicle. However, the place for mounting can be arbitrarily selected; i.e., the antenna device may be installed in an aggregated manner on the upper surface of the inner wall of a hood (engine room) of the vehicle, trunk room or roof of the vehicle, requiring simple mounting operation in the same manner as described above.

In this case, too, the battery is arranged near thereto on the upper surface of the inner wall of the engine room, the power source for the rear lamp is arranged near thereto on the upper surface of the inner wall of the trunk room, and the power source is effectively maintained. A room lamp is arranged in the roof of the vehicle, and the power source is effectively maintained, too.

In the foregoing was described the case where the antenna device was mounted on a car. It is, however, also possible to easily mount the antenna on those other than the car. For example, the antenna device can be mounted on trains for managing the operation and on ships.

Embodiment 3

The above-mentioned embodiment 1 has dealt with the case where the antenna units 11 to 18 and the core unit 20 were aggregated together through the connector portions formed on the surfaces opposed to one another. They, however, may be aggregated together through joining/securing portions, connector portions, and a case substrate having various wirings and harness portions.

Described below with reference to the drawings is an embodiment 3 of the present invention in which the antenna units are aggregated through the case substrate.

Figure 6:
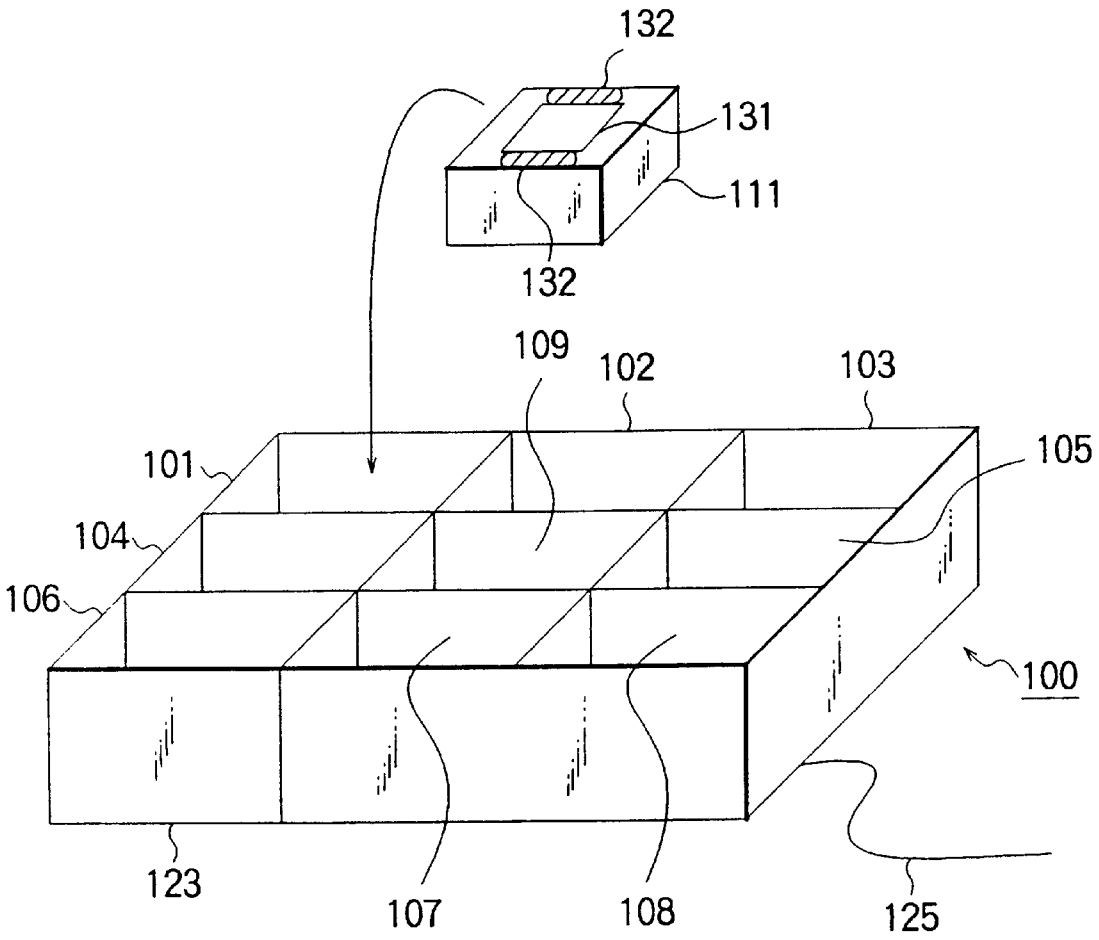
FIG. 6 is a perspective view illustrating a case substrate according to an embodiment 3 of the present invention.
Figure 7:
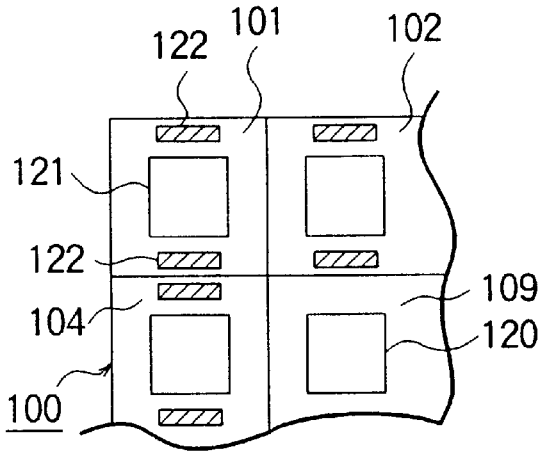
FIG. 7 is a plan view illustrating a state where the case substrate of FIG. 6 is viewed from the upper side.

FIG. 6 is a perspective view illustrating the case substrate according to the embodiment 3 of the present invention, and FIG. 7 is a plan view illustrating a state where part of the case substrate of FIG. 6 is viewed from the upper side.

In FIGS. 6 and 7, the case substrate 100 has a plurality of accommodation spaces 101 to 109 divided to correspond to the antenna units and the core unit to accommodate therein the antenna units 111 and the core unit 120 integrally together.

The case substrate 100, further, has detachable connector portions 121 and joining/securing portions 122 (see FIG. 7) as well as wirings (not shown) for connecting the connector portions 121 on the surfaces in the accommodation spaces 101 to 109 for the antenna units and the core unit.

Furthermore, the case substrate 100 has a mounting portion on the bottom surface 123 thereof (see FIG. 6) that is opposed to an external device so as to be secured to the external device, and a harness portion 125 connected to the external circuit device from the core unit 120.

In FIG. 6, the antenna unit 111 that is representatively shown has a connector portion 131 and a joining/securing portion 132 that are opposed to the connector portion 121 and the joining/securing portion 122 of the case substrate, and is inserted in the accommodation space 101 as indicated by an arrow.

Other antenna units (not shown) and the core unit 120 (see FIG. 7) are also inserted in the accommodation spaces 102 to 109 in the same manner.

By interposing the case substrate 100 having accommodation spaces 101 to 109 as shown in FIG. 6, the antenna units 111 having the same block constitution as the core unit 120 can be easily positioned and aggregated.

The antenna units have the connector portions 121 and the joining/securing portions 122 at the same positions and maintaining the same shapes. Therefore, the antenna units are simply inserted in the accommodation spaces 101 to 109 facilitating the mounting operation and the connection operation.

Embodiment 4

In the above-mentioned embodiment 1, the antenna units were arranged in the form of a matrix. The antenna units, however, may be arranged in a circular shape.

Described below is an embodiment 4 of the present invention in which the antenna units are arranged in a circular shape.

Figure 8:
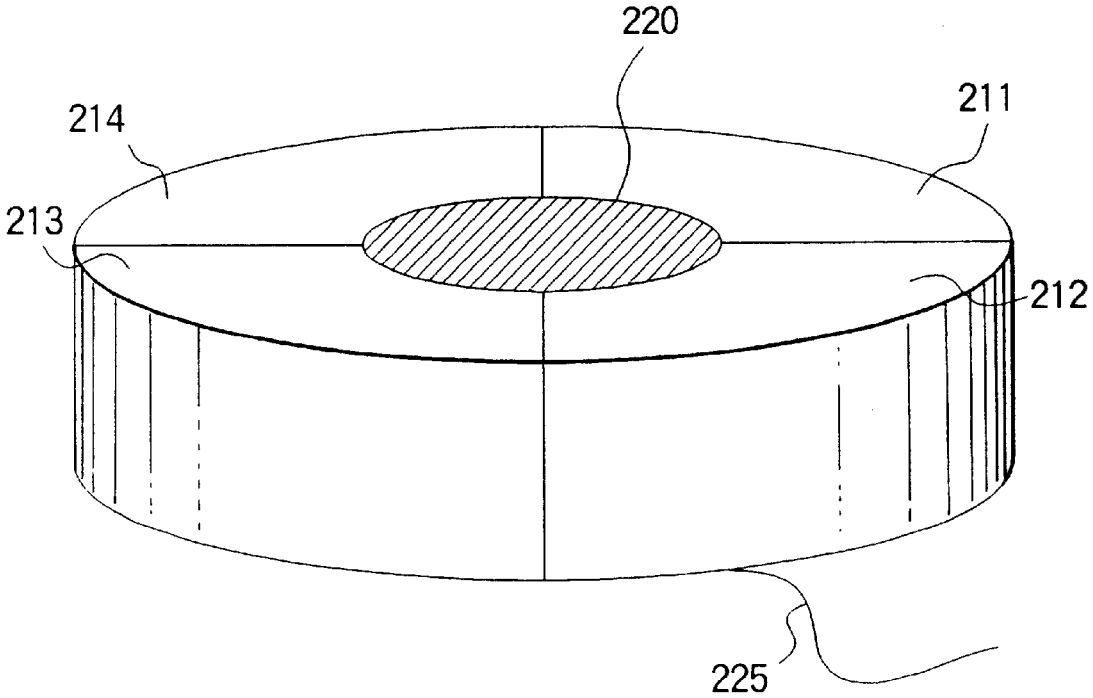
FIG. 8 is a perspective view illustrating an embodiment 4 of the present invention.
Figure 9:
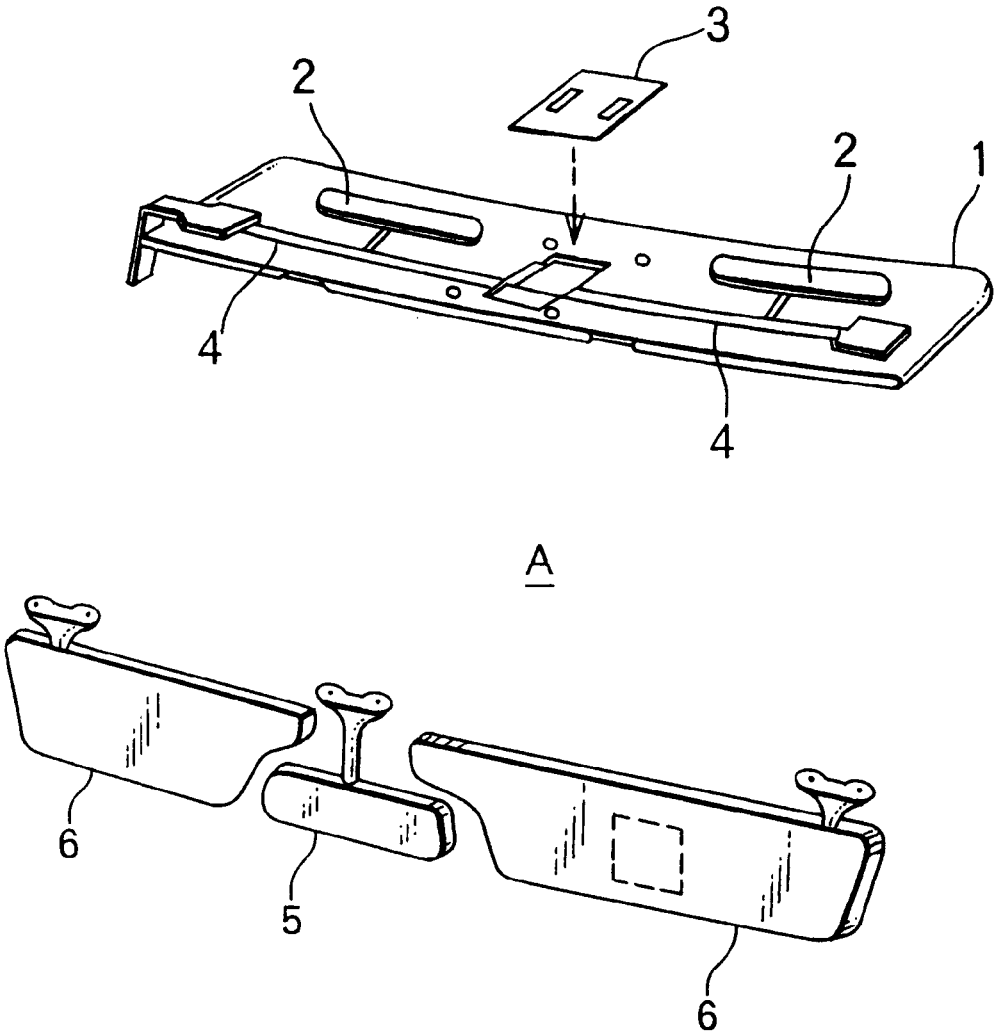
FIG. 9 PRIOR ART
FIG. 9 is a perspective view illustrating a conventional antenna device in a disassembled manner.
Figure 10:
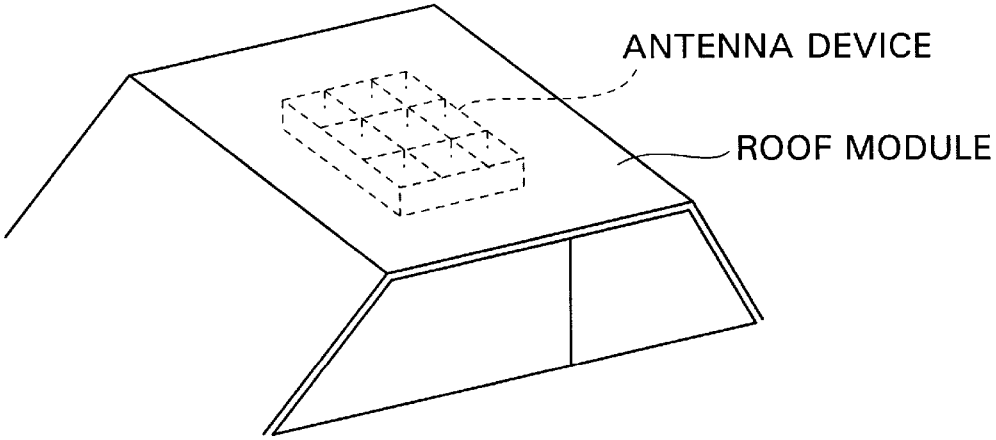
FIG. 10 is a perspective view illustrating an antenna unit arranged in the roof module of a vehicle.
Figure 11:
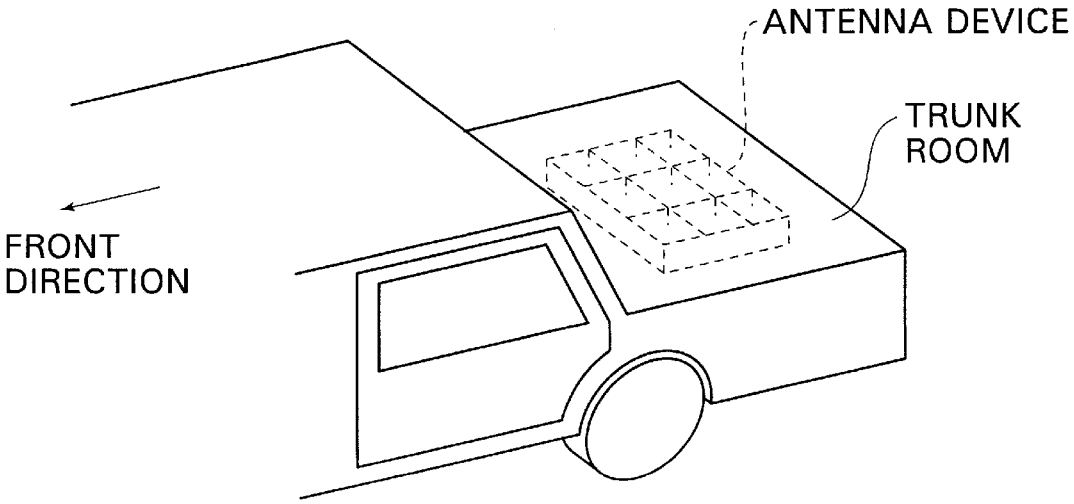
FIG. 11 is a perspective view illustrating an antenna unit arranged on the upper surface of the inner wall of a trunk of a vehicle.

FIG. 8 is a perspective view illustrating an embodiment 4 of the present invention and in which the four antenna units are constituted in an aggregated manner.

In FIG. 8, the antenna units 211 to 214 are arranged in the form of a ring along the outer peripheral surface of the core unit 220 having a circular plane as a center.

The antenna units 211 to 214 are directly coupled to the core unit 220 via the connector portions (not shown) on the opposing surfaces in the same manner as described above. The core unit 220 has a harness portion 225.

Even when the antenna units 211 to 214 are circularly arranged about the core unit 220 as shown in FIG. 8, it is allowed to electrically connect the antenna units 211 to 214 to the core unit 220.

In this case, the antenna units 211 to 214 have the same block shape, and the connector portions are arranged in the same manner, facilitating the electric connection to the core unit 220 and easy assembling.

What is claimed is:

1. An antenna device comprising:

a plurality of antenna units integrally arranged neighboring each other; and a core unit arranged integrally with said antenna units at a central position, to feed electric power to said antenna units; wherein, each of said antenna units and said core unit has detachable joining/securing portions and connector portions; and each of said antenna units is electrically connected to said core unit via said connector portions.

2. An antenna device according to claim 1, wherein provision is made of a case substrate for containing said antenna units and said core unit integrally together, and said case substrate has detachable joining/securing portions and connector portions on surfaces thereof opposed to said antenna units and said core unit.

3. An antenna device according to claim 2, wherein said case substrate has a plurality of accommodation spaces that are divided to individually correspond to said antenna units and said core unit.

4. An antenna device according to claim 2, wherein said case substrate has a mounting portion on the surfaces thereof opposed to an external equipment so as to be secured to said external equipment.

5. An antenna device according to claim 1, wherein said antenna units have separate antenna elements, filter circuits and amplifiers having different characteristics.

6. An antenna device according to claim 1, wherein said core unit has a harness portion for connecting transmission/reception lines and power source lines for said antenna units to an external circuit device in an aggregated manner.

7. An antenna device according to claim 1, wherein said plurality of antenna units include at least any one of an AM antenna unit, an FM antenna unit, a TV antenna unit, a navigation antenna unit, an ETC antenna unit and an amateur wireless antenna unit mounted on a car.

8. An antenna device according to claim 7, wherein said antenna units are arranged in an aggregated manner in a roof module of a vehicle.

9. An antenna device according to claim 7, wherein said antenna units are arranged in an aggregated manner on an upper surface of an inner wall of one of an engine room, trunk room and a roof of a vehicle.

10. An antenna device comprising:

a plurality of antenna units integrally arranged neighboring each other; and a core unit arranged integrally with said antenna units to feed electric power to said antenna units; wherein, each of said antenna units and said core unit has detachable joining/securing portions and connector portions; and each of said antenna units is electrically connected to said core unit via said connector portions;

wherein the joining/securing portions and the connector portions of each of the antenna units are provided on at least one surface thereof opposed to said core unit, and the joining/securing portions and the connector portions of said core unit are provided on the surfaces thereof opposed to at least one of said antenna units.

11. An antenna device according to claim 10, wherein said antenna units and said core unit have quadrilateral planes, said antenna units are arranged in the form of a matrix with the core unit as a center, the antenna units neighboring said core unit among said antenna units are directly coupled to said core unit via said connector portions, the antenna units that are not neighboring said core unit among said antenna units are directly coupled to other neighboring antenna units via said connector portions and are electrically connected to said core unit via said other antenna units.

12. An antenna device according to claim 10, wherein said core unit has a circular plane, and said antenna units are arranged like a ring along the outer peripheral surface of said core unit with said core unit as a center, and are directly coupled to said core unit via said connector portions.

13. An antenna device according to claim 10, wherein at least either one of said antenna unit and said core unit has a mounting portion on the surface thereof opposed to an external equipment so as to be secured to said external equipment.

* * * * *